US010954050B2

(12) United States Patent
Liao et al.

(10) Patent No.: US 10,954,050 B2
(45) Date of Patent: Mar. 23, 2021

(54) SHOULDER-FILLED INFLATABLE BAG

(71) Applicant: KUNSHAN AIRBAG PACKING CORP, Kunshan (CN)

(72) Inventors: Kao-Hsiung Liao, Kunshan (CN); Ping-Yuan Liao, Kunshan (CN)

(73) Assignee: KUNSHAN AIRBAG PACKING CORP, Kunshan (CN)

( * ) Notice: Subject to any disclaimer, the term of this patent is extended or adjusted under 35 U.S.C. 154(b) by 0 days.

(21) Appl. No.: 16/680,947

(22) Filed: Nov. 12, 2019

(65) Prior Publication Data

US 2020/0156844 A1 May 21, 2020

(30) Foreign Application Priority Data

Nov. 16, 2018 (TW) ..... 107140930

(51) Int. Cl.
*B65D 81/05* (2006.01)

(52) U.S. Cl.
CPC ..... *B65D 81/052* (2013.01)

(58) Field of Classification Search
CPC ..... B65D 81/052; B65D 81/051; B65D 81/05
USPC ..... 206/522, 521
See application file for complete search history.

(56) References Cited

U.S. PATENT DOCUMENTS

| | | | | |
|---|---|---|---|---|
| 7,000,767 | B2 * | 2/2006 | Tanaka | B65D 81/052 206/522 |
| 2014/0224700 | A1 * | 8/2014 | Scarbrough | B65D 81/052 206/522 |
| 2017/0121093 | A1 * | 5/2017 | Liao | B65D 81/052 |
| 2018/0273272 | A1 * | 9/2018 | Liao | B65D 81/03 |
| 2019/0055075 | A1 * | 2/2019 | Liao | B65D 81/052 |

* cited by examiner

*Primary Examiner* — Steven A. Reynolds
(74) *Attorney, Agent, or Firm* — Rabin & Berdo, P.C.

(57) ABSTRACT

A shoulder-filled inflatable bag includes a box body and a cover body. The shoulder-filled inflatable bag can protect the packaged objects, such as a bottle, especially a bottle having shoulders, such as a detergent, a laundry detergent, and etc. In addition to protecting the bottle from external impact, especially the neck of a protective bottle, the shoulder-filled inflatable bag effectively disperses the pressure on the bottle, so that the bottle is not broken due to pressure during transportation or handling.

10 Claims, 5 Drawing Sheets

SHOULDER-FILLED INFLATABLE BAG

CROSS-REFERENCE TO RELATED APPLICATION

This non-provisional application claims priority under 35 U.S.C. § 119(a) to Patent Application No. 107140930 filed in Taiwan, R.O.C. on Nov. 16, 2018, the entire contents of which are hereby incorporated by reference.

BACKGROUND

Technical Field

The present invention provides an inflatable bag, in particular, to an inflatable bag that has a necking structure and that is configured to package shipments.

Related Art

A logistics industry has become an indispensable requirement for life with the social progress and prosperity. Therefore, people pay more attention to the packaging and protection for shipments.

Some bottles are packaged with paperboard or styrofoam for transportation. However, the paperboard has weak protection capability, and the styrofoam is large in volume and not environmentally friendly, both of which can provide limited protection. Especially for bottles containing liquid, the package seems to be quite important in protection. For example, some bottles with special structures have the combination of a handle, a bottle cap, a bottleneck, and a bottle body. The paperboard and styrofoam packaging mentioned above are limited. The overall packaging volume is large and cost-consuming. Insufficient packing easily cause the bottle to be broken, especially at a slit between the bottle cap and the bottleneck, which causes the liquid to flow out from inside.

SUMMARY

In view of this, embodiments of the present invention propose a shoulder-filled inflatable bag including a box body and a cover body.

The box body includes a front surface wall, a rear surface wall, and a top surface wall. The front surface wall includes a plurality of front wall air columns. A front end and a bottom end of the front wall air column are respectively defined as a first top edge and a first bottom edge. The rear surface wall is opposite to the front surface wall, and the rear surface wall includes a plurality of rear wall air columns. The front end and the bottom end of the rear wall air column are respectively defined as a second top edge and a second bottom edge. Two sides of the rear surface wall are bonded to two sides of the front surface wall, the rear surface wall and the front surface wall are bonded by heat sealing to form two heat sealed blocks, and there is a contraction cavity between the heat sealed blocks. The top surface wall includes a plurality of top surface air columns. Two sides of the top surface wall are respectively connected to the first top edge of the front surface wall and the second top edge of the back surface wall, to form a first accommodating space and a lateral passage respectively. The first accommodating space is located inside the contraction cavity, and the lateral passage is located outside the contraction cavity.

The cover body is combined with the box body. The cover body includes a cover body front surface wall and a cover body rear surface wall opposite to each other, and a connection surface wall. Two sides of the cover body front surface wall are bonded to two sides of the cover body rear surface wall. The two sides of the connection surface wall are respectively connected to a bottom end of the cover body front surface wall and a bottom end of the cover body rear surface wall, to form a second accommodating space.

For the shoulder-filled inflatable bag as described above, in one embodiment, the front surface wall further includes a body portion and a folded portion. The body portion is adjacent to the folded portion, the heat sealed blocks are located on the body portion, and a bottom end of the folded portion is the first bottom edge. The folded portion is folded by a fold line to cover the body portion, and the first bottom edge is bonded to the body portion.

For the shoulder-filled inflatable bag as described above, in one embodiment, the cover body rear surface wall is connected to the second bottom edge.

For the shoulder-filled inflatable bag as described above, in one embodiment, the cover body front surface wall includes a plurality of front air columns, the cover body rear surface wall includes a plurality of rear air columns, and the connection surface wall includes a plurality of connection air columns.

For the shoulder-filled inflatable bag, in one embodiment, the cover body front surface wall further includes a contraction-expansion portion and two side portions, and the side portions are respectively located on two sides of the contraction-expansion portion. The contraction-expansion portion includes a plurality of intermediate air columns, either of the side portions includes at least one side portion air column, and a volume of the intermediate air column is less than that of the side portion air column.

For the shoulder-filled inflatable bag as described above, in one embodiment, a bottom end of the front surface wall is placed in the cover body.

For the shoulder-filled inflatable bag as described above, in one embodiment, a bottom end of the front surface wall is located outside the cover body.

For the shoulder-filled inflatable bag as described above, in one embodiment, the bottom end of the front surface wall is further bonded to the cover body.

For the shoulder-filled inflatable bag as described above, in one embodiment, cross sections on two sides of the transverse passage are geometric shapes.

For the shoulder-filled inflatable bag as described above, in one embodiment, the cross sections on the two sides of the lateral passage are inverted triangular shapes.

The packaged object such as a bottle can be protected by the shoulder-filled inflatable bag according to one or more embodiments of the present invention. In addition to protecting the bottle from external impact, especially the neck of the protective bottle, the bottle is not broken due to pressure during transportation or handling, effectively resolving the problems of the prior art.

DETAILED DESCRIPTION

Figure 1:
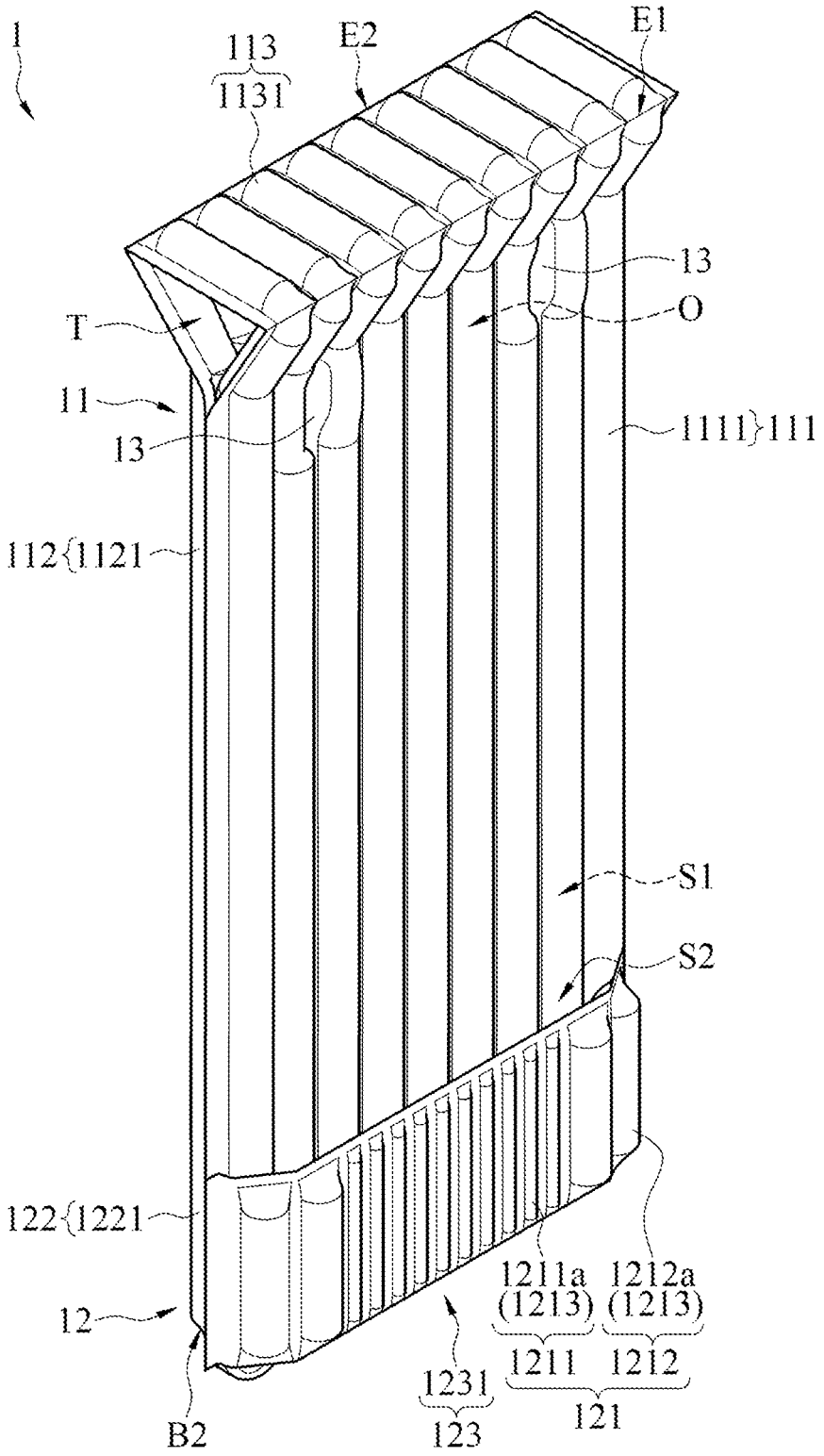
FIG. 1 is a schematic diagram of an appearance of an embodiment of a shoulder-filled inflatable bag according to the present invention.
Figure 2:
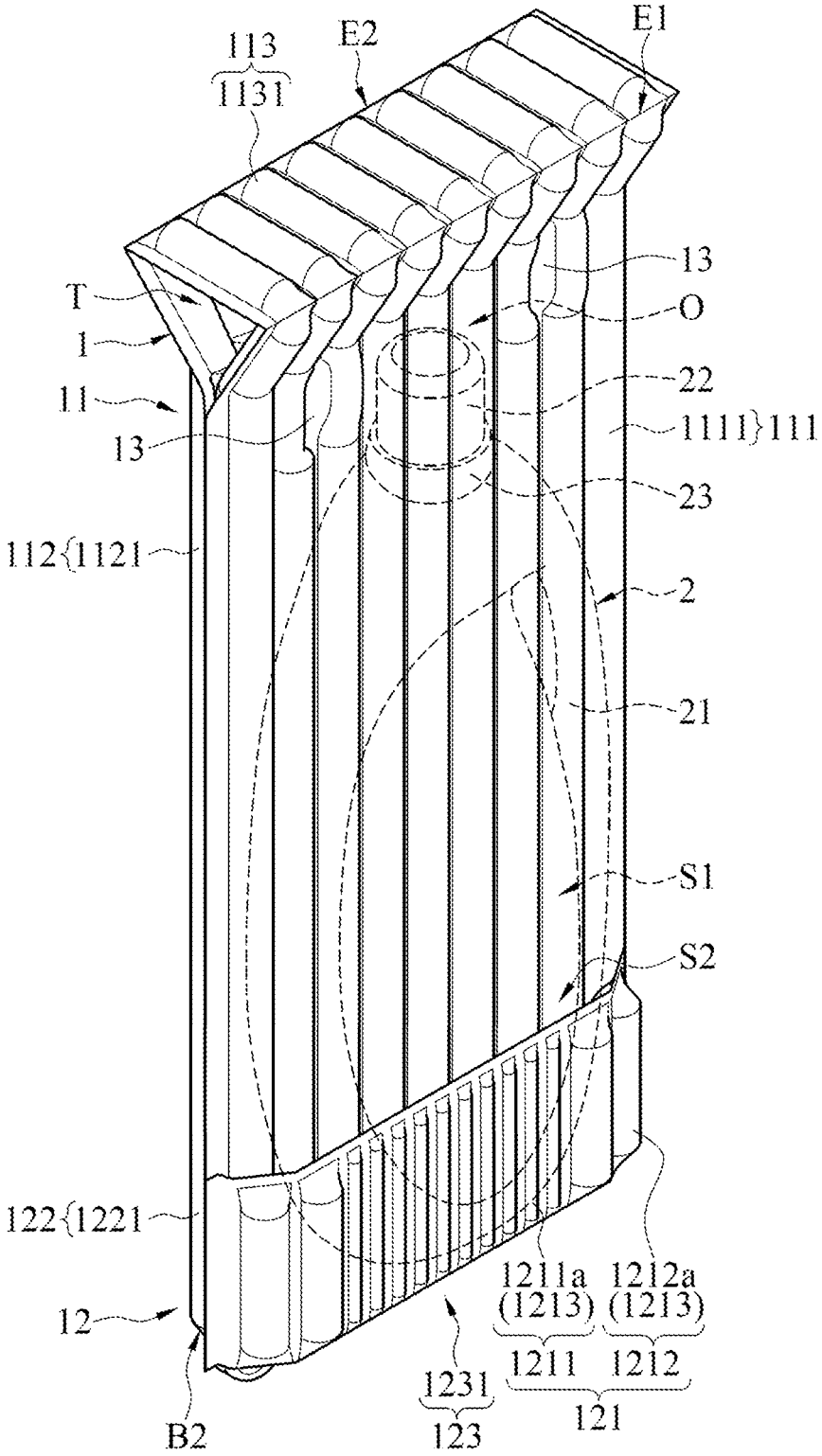
FIG. 2 is a diagram showing a usage state of an embodiment shown in FIG. 1.

Referring to FIG. 1 to FIG. 2, FIG. 1 is a schematic diagram of an appearance of an embodiment of a shoulder-filled inflatable bag 1 of the present invention. FIG. 2 is a diagram showing a usage state of an embodiment shown in FIG. 1.

As shown in FIG. 1, the shoulder-filled inflatable bag 1 includes a box body 11 and a cover body 12.

The box body 11 includes a front surface wall 111, a rear surface wall 112, and a top surface wall 113. The front surface wall 111 includes a plurality of front wall air columns 1111, which are arranged longitudinally. A front end and a bottom end of the front wall air column 1111 are respectively defined as a first top edge E1 and a first bottom edge B1. The rear surface wall 112 is opposite to the front surface wall 111, and the rear surface wall 112 includes a plurality of rear wall air columns 1121, which are arranged longitudinally. A front end and a bottom end of the rear wall air column 1121 are respectively defined as a second top edge E2 and a second bottom edge B2, and two sides of the rear surface wall 112 are bonded to two sides of the front surface wall 111 partially or fully, which is not limited in the present invention. The rear surface wall 112 and the front surface wall 111 are bonded by heat sealing to form two heat sealed blocks 13, and there is a contraction cavity O between the heat sealed blocks 13. The top surface wall 113 includes a plurality of top surface air columns 1131, of which two sides are respectively connected to a first top edge E1 of the front surface wall 111 and a second top edge E2 of the rear surface wall 112 to form a first accommodating space S1 and a lateral passage T respectively. The first accommodating space S1 is located inside the contraction cavity O, and the lateral passage T is located outside the contraction cavity O.

The cover body 12 may be combined with the box body 11. The cover body 12 includes a cover body front surface wall 121 and a cover body rear surface wall 122 opposite to each other, and a connection surface wall 123. Two sides of the cover body front surface wall 121 are bonded to two sides of the cover body rear surface wall 122. Two sides of the connection surface wall 123 are respectively connected to a bottom end of the cover body front surface wall 121 and a bottom end of the cover body rear surface wall 122, to form a second accommodating space S2. In this embodiment, the cover body front surface wall 121 includes a plurality of front air columns 1213, the cover body rear surface wall 122 includes a plurality of rear air columns 1221, and the connection surface wall 123 includes a plurality of connection air columns 1231.

In some embodiments, the box body 11 and the cover body 12 are separate components to be combined to package shipping materials. In some embodiments, shipping materials are combined and packaged in a connected manner. A manner of the combination of the box body 11 and the cover body 12 is not limited in the present invention.

In some embodiments, the box body 11 and the cover body 12 are formed by a plurality of membranes via heat sealing and inflation. Certainly, as mentioned above, when the box body 11 and the cover body 12 are made of a plurality of different membranes when being separate components. In the embodiments shown in FIG. 1 and FIG. 2, the cover body rear surface wall 122 is connected to the second bottom edge B2. In other words, in this embodiment, the box body 11 and the cover body 12 may be formed by a plurality of membranes via heat sealing and inflation, or the box body 11 is bonded to the cover body 12 together by heat sealing.

As shown in FIG. 2, for example, the shipping material is a bottle 2. In some embodiments, liquid such as laundry detergent, dishwashing liquid, or other cleaning products is contained in the bottle. Therefore, how to protect a bottle body 21 from external impact to be broken is quite important. The bottle body 21 of the bottle 2 may be placed in the first accommodating space S1. The heat sealed block 13 is located above the shoulder of the bottle. The contraction cavity O between the heat sealed blocks 13 provides the space for a bottle neck 23 to be placed and protects the bottle neck 23. Because the bottle neck 23 is located at a location at which the bottle cap 22 is combined with the bottle body 21, there is a high risk for liquid leakage. Therefore, the heat sealed block 13 and the air column structure can be used to effectively protect the bottle 2, especially, a portion of the bottle 2 with an indenter structure (a spring included inside), the neck part being relatively weak. If the shoulder-filled inflatable bag 1 is used for packaging, the bottle can be effectively protected from damage.

Alternatively, the cover body 12 covers a lower portion of the bottle body 21 of the bottle 2. In this embodiment, the bottom end of the front surface wall 111 and the lower portion of the bottle body 21 are placed in the cover body 12, that is, placed in the second accommodating space S2 to provide protection for the lower portion of the bottle body 21.

In addition, in this embodiment, the cover body front surface wall 121 further includes a contraction-expansion portion 1211 and two side portions 1212. The side portions 1212 are respectively located at two sides of the contraction-expansion 1211, and the contraction-expansion portion 1211 includes a plurality of intermediate air columns 1211*a*. Each side portion 1212 includes at least one side air column 1212*a*, where a volume of the intermediate air column 1211*a* is less than a volume of the side air column 1212*a*. The structure is designed to facilitate operations of a user or an operator on the cover body 12 to pull open the cover body front surface wall 121, to fit the lower portion of the bottle body 21 and the bottom end of the front surface wall 111.

Figure 3:
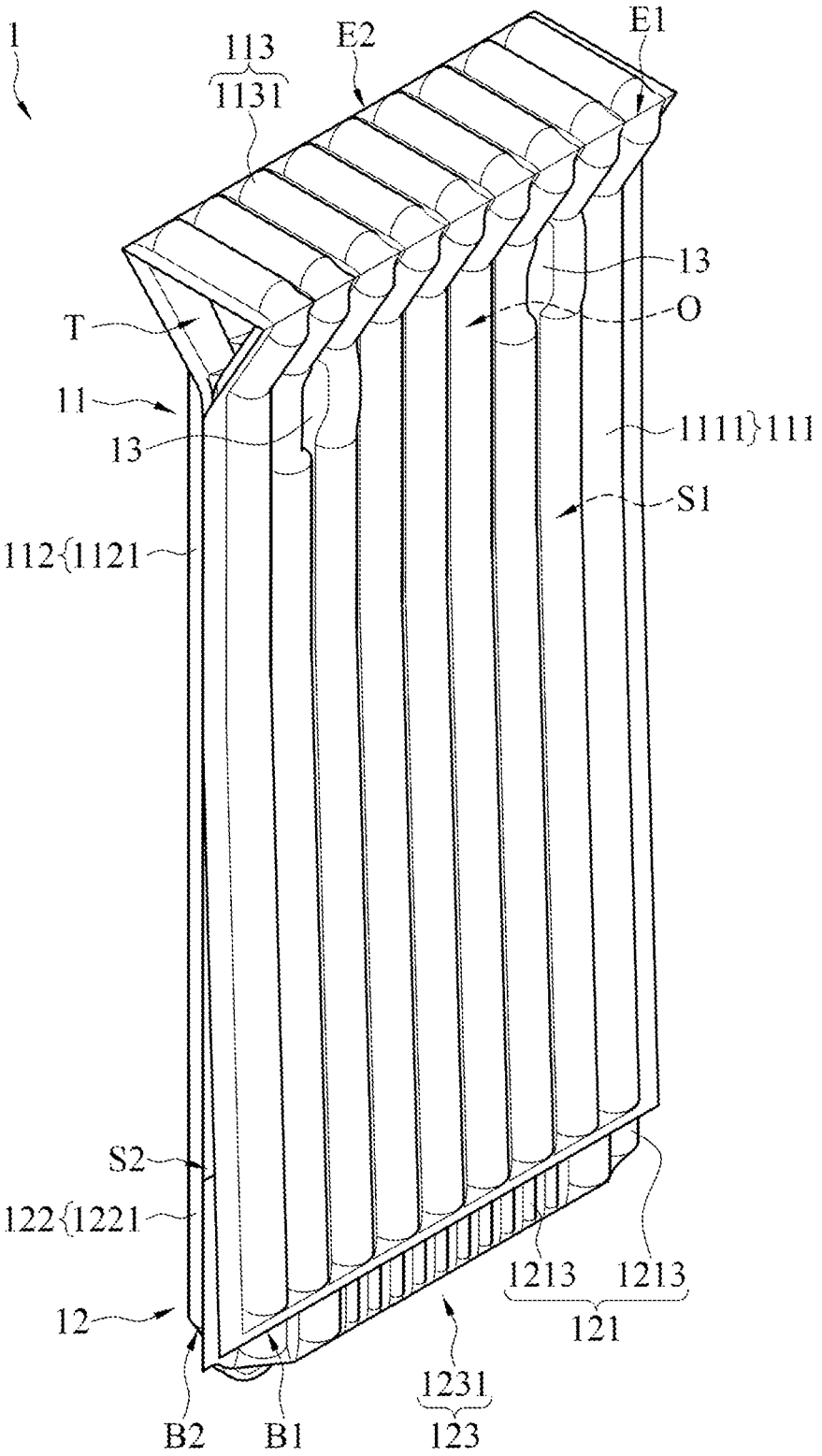
FIG. 3 is a schematic diagram of an appearance of an embodiment of a shoulder-filled inflatable bag according to the present invention.

Referring to FIG. 3, FIG. 3 is a schematic diagram of an appearance of an embodiment of a shoulder-filled inflatable bag 1 of the present invention. Different from the embodiments shown in FIG. 1 and FIG. 2, the bottom end of the front surface wall 111 of the box body 11 is located outside the cover body 12. In other embodiments, the user can further bond the bottom end of the front surface wall 111 to the cover body 12 using glue or by heat sealing, and determine whether to seal the cover body 12 according to the user's requirements, so as to make the shoulder-filled inflatable bag 1 packaged more securely. However, the present invention is not limited.

Figure 4:
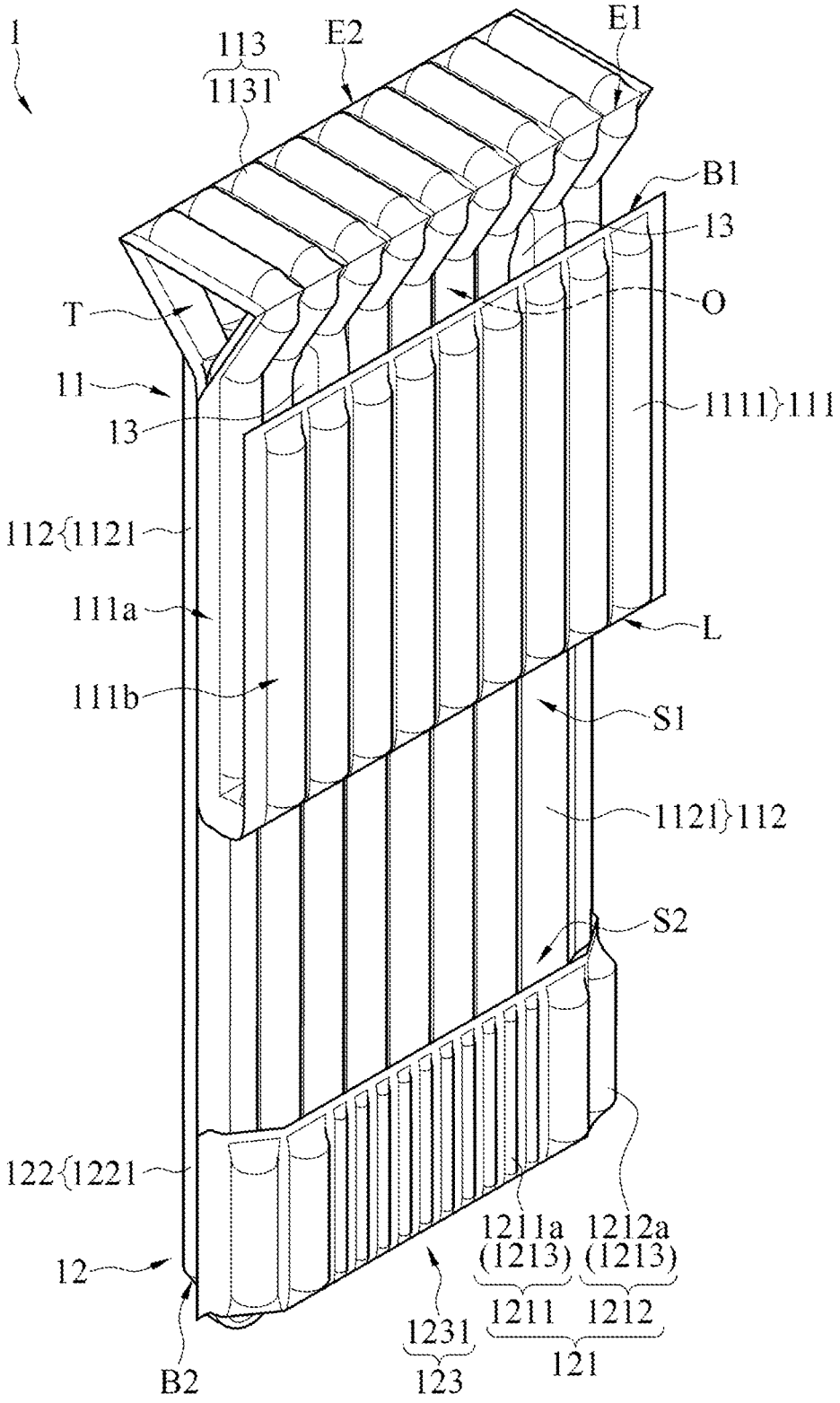
FIG. 4 is a schematic diagram of an appearance of an embodiment of a shoulder-filled inflatable bag according to the present invention.
Figure 5:
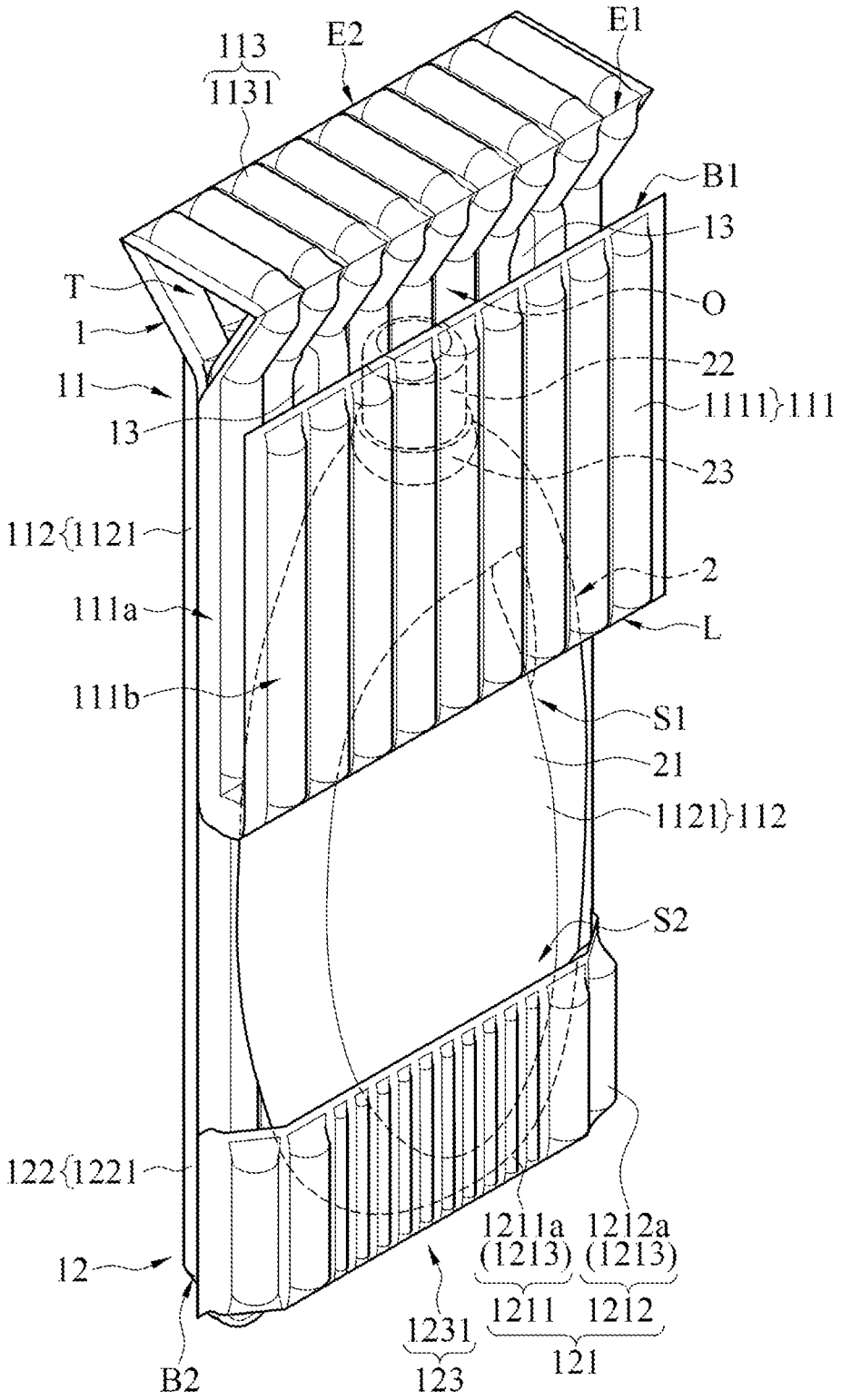
FIG. 5 is a diagram showing a usage state of an embodiment shown in FIG. 4.

Referring to FIG. 4 to FIG. 5, FIG. 4 is a schematic diagram of an appearance of an embodiment of a shoulder-filled inflatable bag 1 of the present invention. FIG. 5 is a diagram showing a usage state of an embodiment shown in FIG. 4.

As shown in FIG. 4, in this embodiment, the front surface wall 111 further includes a body portion 111*a* and a folded portion 111*b*. The body portion 111*a* is adjacent to the folded portion 111*b*. The heat sealed block 13 is located at the body portion 111*a*. A bottom end of the folded portion 111*b* is the first bottom edge B1, and the folded portion 111*b* is folded by a fold line L to cover the body portion 111*a*, the first bottom edge B1 being bonded with the first top edge E1. The structure can be used to strengthen protection of bottle body 21, so that the bottle body cannot be affected by pressure when lying on a plane, and protection for a bottleneck 23 can be strengthened.

In the embodiments shown in FIG. 1 to FIG. 5, cross sections on two sides of the lateral passage T are geometric shapes, such as inverted triangular shapes. However, the present invention is not limited thereto. In some embodiments, the cross section may be a square according to design requirements of the operator.

Sizes of the cross sections on two sides of the lateral passage T is related to a degree of connection to two sides of the front surface wall 111 and the rear surface wall 112, a size and a location of the heat sealed block 13. Generally, a larger cross section of the lateral passage T causes more pressure to be dispersed when the shoulder-filled inflatable bag 1 is compressed at a bottleneck 23, to protect the bottleneck 23, the bottle cap 22, or the indenter structure.

The shoulder-filled inflatable bag according to one or more embodiments of the present invention can protect the packaged objects such as bottles, especially bottles with shoulders, such as detergents, laundry detergents, etc. In addition to protecting the bottle from external impact, especially the neck of the protective bottle (at a juncture of the bottle cap and the bottle body or the indenter structure), the pressure can be effectively dispersed, so that the bottle is not broken due to the pressure during transportation or handling, so as to achieve comprehensive protection.

What is claimed is:

1. A shoulder-filled inflatable bag comprising:

a box body comprising:

a front surface wall comprising a plurality of front wall air columns, a front end and a bottom end of the front wall air columns being respectively defined as a first top edge and a first bottom edge;

a rear surface wall opposite to the front surface wall, the rear surface wall comprising a plurality of rear wall air columns, a front end and a bottom end of the rear wall air columns being respectively defined as a second top edge and a second bottom edge, two sides of the rear surface wall being bonded to two sides of the front surface wall, the rear surface wall and the front surface wall being bonded by heat sealing to form two heat sealed blocks, and there being a contraction cavity between the heat sealed blocks; and a top surface wall comprising a plurality of top surface air columns, two sides of the top surface wall being respectively connected to the first top edge of the front surface wall and the second top edge of the rear surface wall, to form a first accommodating space and a lateral passage respectively, the first accommodating space being located inside the contraction cavity, and the lateral passage being located outside the contraction cavity; and a cover body combined with the box body, the cover body comprising a cover body front surface wall and a cover body rear surface wall opposite to each other, and a connection surface wall, two sides of the cover body front surface wall being bonded to two sides of the cover body rear surface wall, and two sides of the connection surface wall being respectively connected to a bottom end of the cover body front surface wall and a bottom end of the cover body rear surface wall to form a second accommodating space.

2. The shoulder-filled inflatable bag according to claim 1, wherein the front surface wall further comprises a body portion and a folded portion, the body portion is adjacent to the folded portion, the heat sealed blocks are located at the body portion, a bottom end of the folded portion is the first bottom edge, the folded portion is folded along a fold line, to cover the body portion, and the first bottom edge is bonded to the body portion.

3. The shoulder-filled inflatable bag according to claim 1, wherein the cover body rear surface wall is connected to the second bottom edge.

4. The shoulder-filled inflatable bag according to claim 1, wherein the cover body front surface wall comprises a plurality of front air columns, the cover body rear surface wall comprises a plurality of rear air columns, and the connection surface wall comprises a plurality of connection air columns.

5. The shoulder-filled inflatable bag according to claim 1, wherein the cover body front surface wall further comprises a contraction-expansion portion and two side portions, the side portions are respectively located on two sides of the contraction-expansion portion, the contraction-expansion portion comprises a plurality of intermediate air columns, each of the side portions comprises at least one side air column, and a volume of each of the intermediate air columns is less than that of each of the at least one side air column.

6. The shoulder-filled inflatable bag according to claim 1, wherein a bottom end of the front surface wall is placed in the cover body.

7. The shoulder-filled inflatable bag according to claim 1, wherein a bottom end of the front surface wall is placed outside the cover body.

8. The shoulder-filled inflatable bag according to claim 7, wherein the bottom end of the front surface wall is further bonded to the cover body.

9. The shoulder-filled inflatable bag according to claim 1, wherein cross sections on two sides of the lateral passage are of geometric shapes.

10. The shoulder-filled inflatable bag according to claim 9, wherein the cross sections on the two sides of the lateral passage are of inverted triangular shapes.

* * * * *